US006443324B1

(12) United States Patent
Buntain

(10) Patent No.: US 6,443,324 B1
(45) Date of Patent: Sep. 3, 2002

(54) BEVERAGE CONTAINER WITH SELF-CONTAINED STRAW

(76) Inventor: Vaughn Kent Buntain, 739 Scotch Plains Ave., Westfield, NJ (US) 07090

( * ) Notice: Subject to any disclaimer, the term of this patent is extended or adjusted under 35 U.S.C. 154(b) by 0 days.

(21) Appl. No.: 09/614,516

(22) Filed: Jul. 12, 2000

(51) Int. Cl.[7] ..... A47G 19/22

(52) U.S. Cl. ..... 220/705; 220/707; 220/710; 220/906

(58) Field of Search ..... 220/705, 706, 220/707, 709, 710, 906; 222/566, 567, 530, 527

(56) References Cited

U.S. PATENT DOCUMENTS

| | | | | | |
|---|---|---|---|---|---|
| 3,081,926 | A | * | 3/1963 | Newton | 220/906 |
| 3,268,792 | A | * | 8/1966 | Barmherzig | 220/707 |
| 3,547,308 | A | * | 12/1970 | Gilliem | 220/705 |
| 3,656,654 | A | | 4/1972 | Brinkley, III | |
| 3,825,149 | A | * | 7/1974 | Brown et al. | 220/906 |
| 4,078,692 | A | | 3/1978 | Stein | |
| 4,109,817 | A | | 8/1978 | Payne et al. | |
| 4,226,356 | A | | 10/1980 | Lemelson | |
| 4,228,913 | A | | 10/1980 | Mack et al. | |
| 4,286,745 | A | * | 9/1981 | Fukuoka | 220/906 |
| 4,356,927 | A | | 11/1982 | Cooper et al. | |
| 4,441,640 | A | * | 4/1984 | Lottick | 220/705 |
| 4,712,702 | A | | 12/1987 | Ayabe et al. | |
| 5,054,639 | A | | 10/1991 | Ahn | |
| 5,071,019 | A | * | 12/1991 | Sizemore | 220/709 |
| 5,172,827 | A | | 12/1992 | Chang et al. | |
| 5,253,779 | A | | 10/1993 | Lee | |
| 5,353,983 | A | | 10/1994 | Miller | |
| 5,361,935 | A | * | 11/1994 | Sagucio | 220/709 |
| 5,425,471 | A | | 6/1995 | Wendt | |
| 5,431,297 | A | | 7/1995 | Rosello | |
| 5,482,202 | A | | 1/1996 | Wen | |
| 5,522,524 | A | | 6/1996 | Nmngani | |
| 5,647,499 | A | | 7/1997 | Piazza | |
| 5,687,872 | A | | 11/1997 | Nmngani | |
| 5,722,561 | A | | 3/1998 | Biondich et al. | |
| 5,788,106 | A | | 8/1998 | Hotinski | |
| 5,819,979 | A | | 10/1998 | Murphy et al. | |
| 6,076,729 | A | * | 6/2000 | Cornell et al. | 220/707 |
| 6,142,326 | A | * | 11/2000 | Cornell et al. | 220/706 |

* cited by examiner

*Primary Examiner*—Lee Young
*Assistant Examiner*—Joseph C. Merek
(74) *Attorney, Agent, or Firm*—Ira C. Edell

(57) ABSTRACT

A tab top beverage can has a compressible drinking straw held between the can bottom and an upwardly extending detachable closed cavity formed in the can top. Detachment of the cavity by a pivoting tab top uncovers a straw access orifice through which the straw is projected by the force of a previously compressed corrugated spring section formed in the straw wall. A bulge located on the straw prevents passage of the straw from the can and facilitates extension of the straw. The tab is attached to the can top by outwardly projecting lips formed on upwardly projecting closed cavities defined in the can top. The cavities extend through openings in the tab and the lips extend beyond the opening perimeters to secure the tab to the cavities and top.

9 Claims, 6 Drawing Sheets

BEVERAGE CONTAINER WITH SELF-CONTAINED STRAW

BACKGROUND OF THE INVENTION

1. Field of the Invention

The present invention relates to tab top beverage cans and, more particularly, to a self-contained self-presenting drinking straw for use in beverage cans.

2. Description of Related Art

Beverage cans have been used for decades with more recent developments including the pull tab opening that removably tears away from the can top to provide access, replacing the need for a separate opener; and more recently, in response to environmental concerns, the access tab that is bent down into the can by a pivot, with both the tab and pivot remaining attached to the can to reduce the debris and pollution and to minimize hazards to wildlife.

Throughout this design evolution, the shape of the can top has remained generally unchanged, with an annular groove formed by raised flange around the can top perimeter acting, unfortunately, as a dirt, dust and residue trap. As a result, drinking directly from such a can is unsanitary and distasteful and results in a situation where the choices left to the consumer are to inconveniently obtain a sanitary packaged straw, with the accompanying costs to the economy and the ecology, or risk the potential health consequences.

In response to this dilemma, a number of inventions have been directed toward the design of a completely self-contained straw that would be stored within the can until use and would reliably present itself to the user upon opening of the tab top.

A number of approaches were suggested in the 1970's and early 1980's when tab tops were completely removed from the can top upon opening which have been replaced with other alternatives by most can manufacturers due to environmental concerns over the discarding of the separated tab tops. U.S. Pat. Nos. 3,656,654 (Brinkley), 4,078,692 (Stein), 4,109,817 (Payne et al), 4,226,356 (Lemalson) and 4,228,913 (Mack et al) are representative of such devices.

U.S. Pat. No. 4,356,927 (Cooper et al) shows a resiliently bent straw held in position in the bottom of the can in a concave slot and at the top by a dimple projecting downward from the tab. The straw is weakly positioned at the top and not secured; moreover, the radical redesign of the pressure-resisting can bottom is undesirable.

U.S. Pat. No. 4,712,702 (Ayabe et al) discloses a self-contained straw that must be manually removed from the tab after opening, compromising the desired improvements in sanitation and convenience.

Various other methods have been developed relating to the presentation of the straw held in a can requiring expensive alterations in the manufacturing process. U.S. Pat. No. 5,054, 639 (Ahn) teaches a floating straw requiring a straw holder and guide to be attached to the interior of the beverage can. In U.S. Pat. No. 5,172,827 (Clang et al) a complex mechanism to pivot a compound curved straw through a pair of adjacent can top tab panels is shown. U.S. Pat. No. 5,253,729 (Lee) presents a resilient telescoping straw requiring a can top surface sloping upward to the top opening.

Despite these efforts, no viable reliable solution has heretofore been presented to provide the consumer with the option of drinking from a sanitary self-contained and convenient beverage can straw or traditional pour spout at a production cost acceptable to the marketplace.

OBJECTS AND SUMMARY OF THE INVENTION

Accordingly, it is a primary object of the present invention to provide a beverage can having a self-contained self-presenting drinking straw that overcomes the deficiencies of the prior art.

Another objective of the present invention is to provide a self-contained beverage can straw that accessibly presents itself to the consumer upon opening of the can tab top without requiring the consumer to handle the straw.

A further object of the present invention is to provide a beverage can assembly with a self-presenting drinking straw that pops-up from a beverage can but is retained partially within the can to prevent loss.

Yet another object of the present invention is to reduce the likelihood of transmitting unsanitary materials from beverage can tops to consumers.

It is also an object to provide an improved beverage can while retaining the essential design elements, fabrication methods, and tooling requirements of the traditional tab top beverage can and the existing techniques for the manufacture of pleated plastic straws without increasing metal material costs.

A supplemental object of the present invention is to provide a method for making a beverage can by simultaneously forming a tab rivet post in the can top during formation of the scored removable cylinder in the can top.

A still further objective of the present invention is to reduce the waste paper and plastic pollution associated with the handling and packaging of individually wrapped straws.

The aforesaid objects are achieved individually and in combination and it is not intended that the invention be construed as requiring that two or more of said objects be combined.

In accordance with the present invention, a telescoping drinking straw is secured in resilient compression between the top and bottom of a beverage can. The top of the straw is releasably retained in a cylindrical chamber formed in a pivoting pull tab at the center of the can top. A bulge or bubble, having a cross-sectional area slightly larger than the tab-formed drinking orifice in the can top, is formed in the straw to prevent inadvertent loss or removal of the straw from the opened can. A centering concave dimple is preferably formed in the can floor to guide and constrain the straw during filling and handling.

The present invention provides an inexpensive, user-friendly and effective means for providing the consumer with a sanitary and convenient alternative to current non-hygienic beverage cans without imposing economically unfeasible demands on current manufacturing procedures.

The above and still further objects, features and advantages of the present invention will become apparent upon considering the following detailed description of preferred embodiments thereof, particularly when viewed in connection with the accompanying drawings wherein like reference numerals in various figures are utilized to designate like components.

BRIEF DESCRIPTIONS OF THE DRAWINGS

DESCRIPTION OF THE PREFERRED EMBODIMENTS

Figure 2:
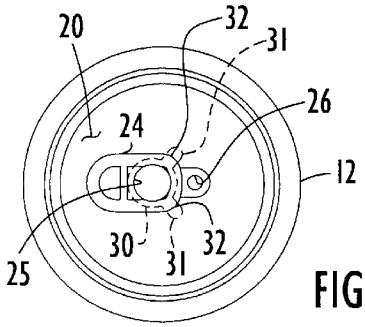
FIG. 2 is a top view in plan of the beverage can of FIG. 1.
Figure 4:
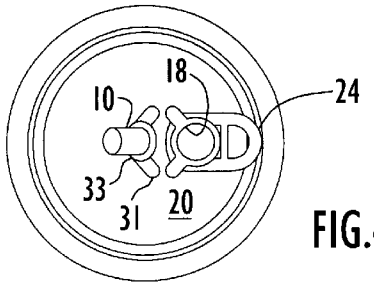
FIG. 4 is a top view in plan of the open beverage can of FIG. 3.
Figure 1:
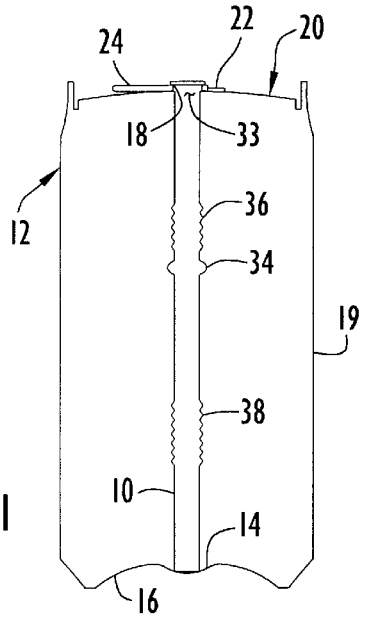
FIG. 1 is an elevation view in cross-section of an unopened beverage can with a self-contained self-presenting drinking straw according to the present invention.
Figure 3:
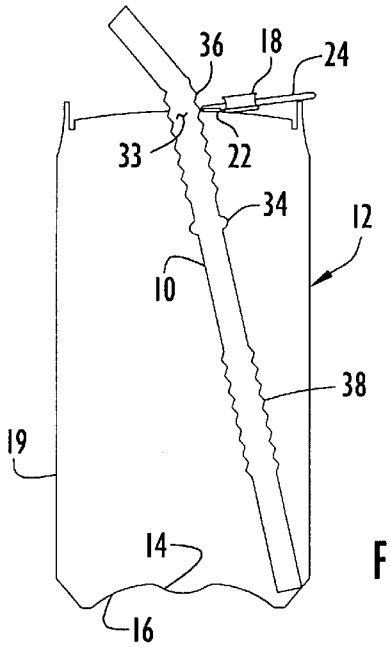
FIG. 3 is an elevation view in cross-section of the beverage can of FIG. 1 after the tab has been opened.
Figure 5:
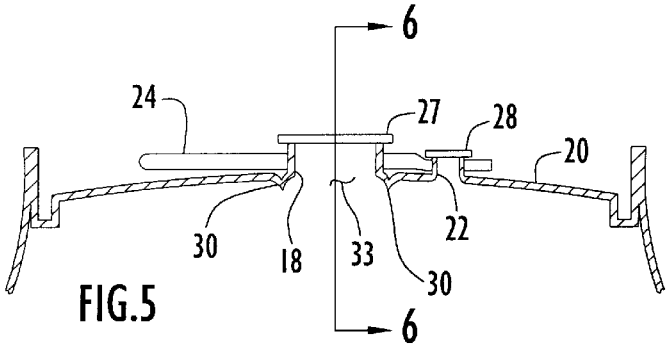
FIG. 5 is a detailed partial side view in cross-section of the top of the beverage can and affixed tab of FIG. 1.
Figure 6:
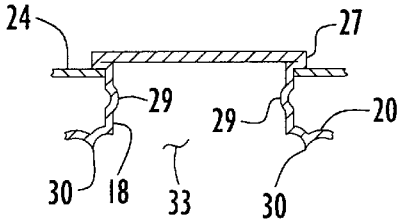
FIG. 6 is a view in section taken through lines 6—6 of FIG. 5.
Figure 8:
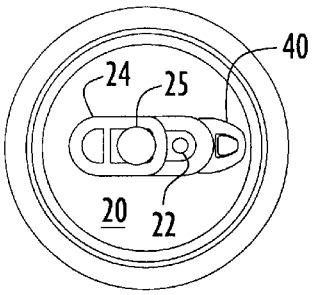
FIG. 8 is a top view in plan of the unopened beverage can of FIG. 7.
Figure 10:
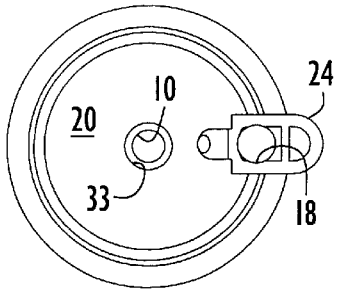
FIG. 10 is a top view in plan of the beverage can of FIG. 9.
Figure 12:
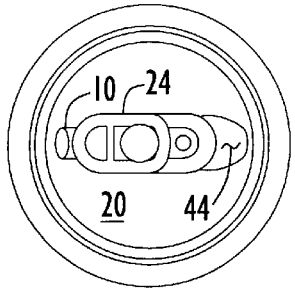
FIG. 12 is a top view in plan of the beverage can of FIG. 11.
Figure 7:
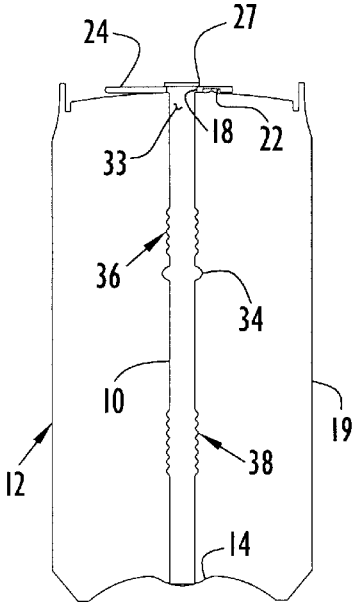
FIG. 7 is an elevation view in cross-section of an unopened beverage can according to a second embodiment of the present invention, whereby the consumer can choose to sip from a) a self-presenting straw and/or b) a traditional pour spout opening.
Figure 9:
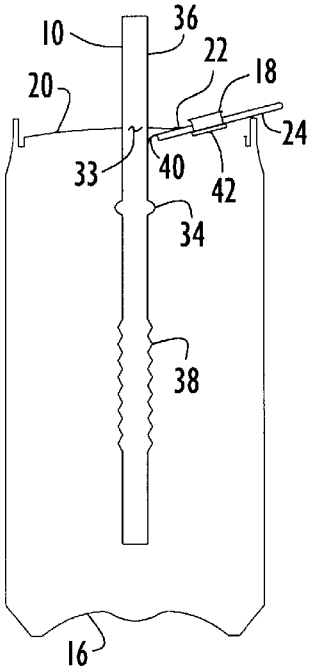
FIG. 9 is an elevation view in cross-section of the beverage can of FIG. 7 after the tab has been fully pivoted for straw access.
Figure 11:
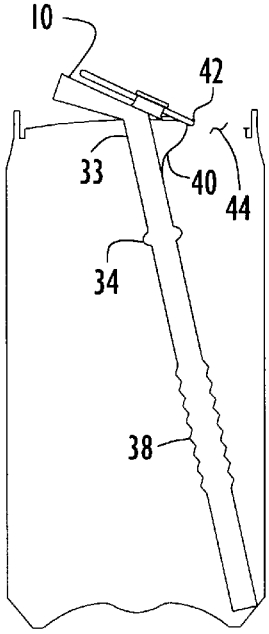
FIG. 11 is an elevation view in cross-section of the beverage can of FIG. 9 after the tab has been pushed back to expose the pour spout and crimp the straw.
Figure 14:
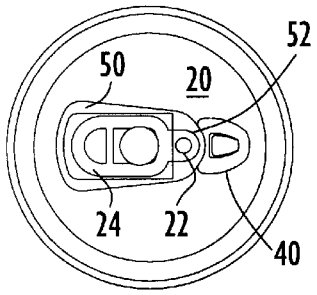
FIG. 14 is a top view in plan of the beverage can of FIG. 13.
Figure 16:
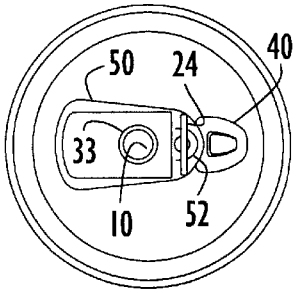
FIG. 16 is a top view in plan of the beverage can of FIG. 15.
Figure 18:
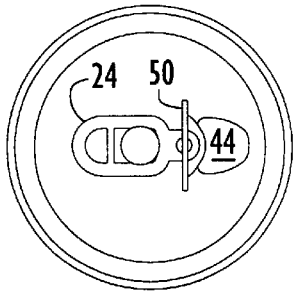
FIG. 18 is a top view in plan of the beverage can of FIG. 17.
Figure 13:
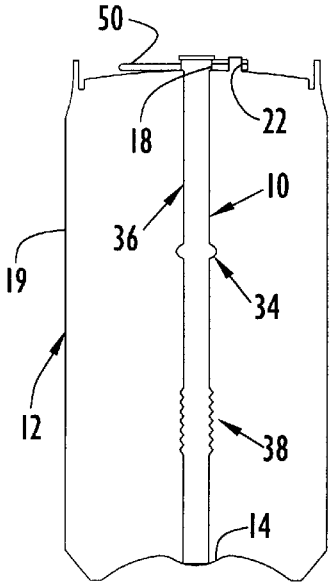
FIG. 13 is an elevation view in cross-section of a beverage can having separate pour and straw tabs according to a third embodiment of the present invention, whereby the consumer may choose between a straw or a traditional pour spout or both.
Figure 15:
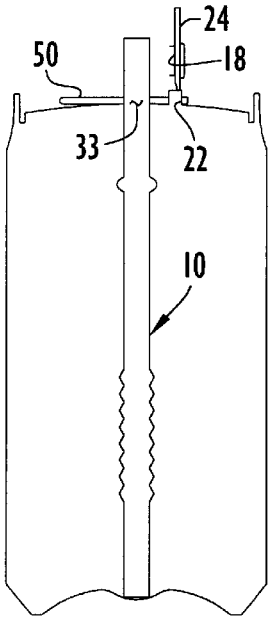
FIG. 15 is a side view in cross-section of the beverage can of FIG. 13 after the straw tab is opened.
Figure 17:
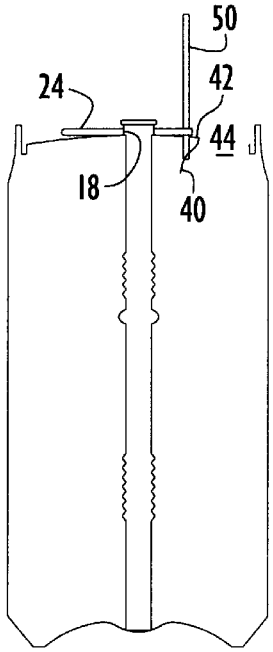
FIG. 17 is an elevation view in cross-section of the beverage can of FIG. 13 after the pour tab is opened.

The terms upwardly, downwardly, top, bottom, etc. are used herein to facilitate the following description and are not intended to be limitations on the structure or orientation of the present invention.

As illustrated in FIGS. 1–6, a drinking straw 10 is retained at its respective ends within an unopened beverage can 12 between a positioning depression 14 formed at the center of can bottom 16 and the interior of an upwardly extending short hollow cylindrical projection 18, defined in the can top 20. Projection 18 is closed at its upper end and open at its lower end to receive the upper end of the straw. Projection 18 is preferably coaxial with can 12. Circumscribing side wall 19 extends from can bottom 16 to can top 20 to define the can periphery.

An upwardly extending cylindrical rivet projection 22 is also formed in can top 20 by means, for example, of a stamping process. A tab top 24 having an aperture or opening 25 defined therein is sized to fit snugly over projection 18. A second aperture or opening 26 defined through tab top 24 is sized to fit over projection 22. During fabrication of the can top, tab top 24 is positioned such that projections 18 and 22 extend through respective apertures 25 and 26. The tab top is then secured in place by a stamping process, or the like, whereby radially projecting annular lips 27 and 28 are formed at prospective upper edges of projections 18 and 22, respectively, to extend beyond the boundaries of apertures 25 and 26 of tab 24. Lips 27 and 28 engage tab 24 to the two projections and, thereby, to the can top. One or more inwardly extending dimples 29 are formed on the interior peripheral wall of cylindrical projection 18 and a tear-away seam or score line 30 is defined on the can top 20 around the perimeter of projection 18. One or more flared extensions 31 aligned in registry with protruding angles or corners 32 formed on each side of tab 24 between cylinder 18 and cylinder 22, defining an access orifice 33. Dimples 29 are sized to lightly grasp the outer wall of the top of straw 10 during assembly and filling as will be described hereinafter.

Alternatively, tab 24 can be affixed to can top 20 by a conventional rivet mechanism in lieu of cylinder 22 and projection 28.

A retention bulge 34 formed near the midlength of straw 10 is sized to prevent passage of the straw from the beverage can through access orifice 33 and to facilitate extension and use of the straw by a consumer.

A pleated extension zone 36 is formed of small crimps in the upper portion of the straw, to permit the straw to be bent easily toward the consumer, and to allow some lengthening of the straw as the pleated crimps are pulled straight. A bellows spring section 38, formed of relatively large resilient accordion pleats or corrugations in the lower portion of the straw sidewall, is held in longitudinal compression between the can top 20 and the depression 14. This compression serves to position and stabilize the straw between cylinder 18 and depression 14 in the unopened beverage can during transportation and handling.

Pivoting of pull tab 24 around cylinder 18, leveraging tab top 24 against the can top 20 generates sufficient force on the scoring around access orifice 33 to fully separate or detach cylinder 18 and rim or lip 27 from can top 20 at tear away seam or score line 30, exposing straw access orifice 33, and lifting straw 10 due to the grasping effect of cylinder dimples 29. The release of compressive force on the straw allows the resilient bellows spring section 38 to expand and lengthen as the accordion sections relax. The straw, previously constrained to a length dictated by the can height, about 4.50 inches, extends to a relaxed length of approximately 5.00 inches, and projects upward through access orifice 33 and subsequently separates from cylinder 18 and dimples 29 thereby presenting itself in a position convenient to the consumer for grasping, for pulling to further stretch the straw by elongating the pleated extension zone 36, and for bending and positioning the straw top for easy use.

In another embodiment, illustrated in FIGS. 7–12, a second scored panel 40 located in the can top on the rivet cylinder side of pull tab 24, has a hinge 42 located under the rivet end of tab 24. In other respects, the features of the embodiment shown in FIGS. 1–6 are unchanged. Pivoting of tab 24 against can top 20 around cylinder 18 in this embodiment simultaneously separates cylinder 18 from the can top around tear-away seam or score line 30 to expose straw access orifice 33 and release the upwardly extending straw 10 while the rivet end of tab 24 exerts leverage on the scoring around panel 40. The scored panel 40 pivots downward around hinge 42 exposing a separate pouring orifice 44 in the top. The tab can then be rotated back toward the unopened position to compress and effectively disable the outwardly extending portion of the straw. This embodiment allows the consumer to selectively sip the beverage through the straw or, alternatively, pour or drink directly from the can.

In a third embodiment, shown in FIGS. 13–18, two separate nested tabs, 24 and 50, are each pivotably attached to the beverage can top by rivet cylinder 22. Pivoting of tab 24 disengages cylinder 18 from the can top releasing straw 10 through straw access orifice 33, but the short shank 52 of tab 24 does not extend to scored access panel 40 and thus does not deflect panel 40 to expose pouring orifice 44. Tab 50 is formed with a cut-out 54 sized to allow tab 50 to be pivoted around rivet cylinder 22 without interfering with straw access tab 24, but with a shank section 56 extending to the hinge 42 of pour access orifice 44. Thus, either tab can be pivoted independently of the other to allow the consumer to select the mode of consumption.

Figure 21:
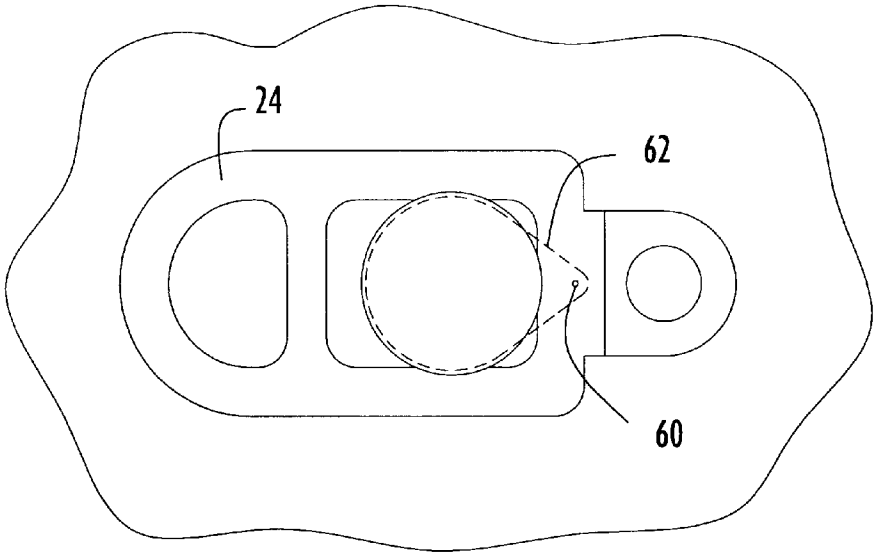
FIG. 21 is a top view of beverage can in claim 1 using an elongated tear-away seam extending around a projection oriented under the tab top.
Figure 22:
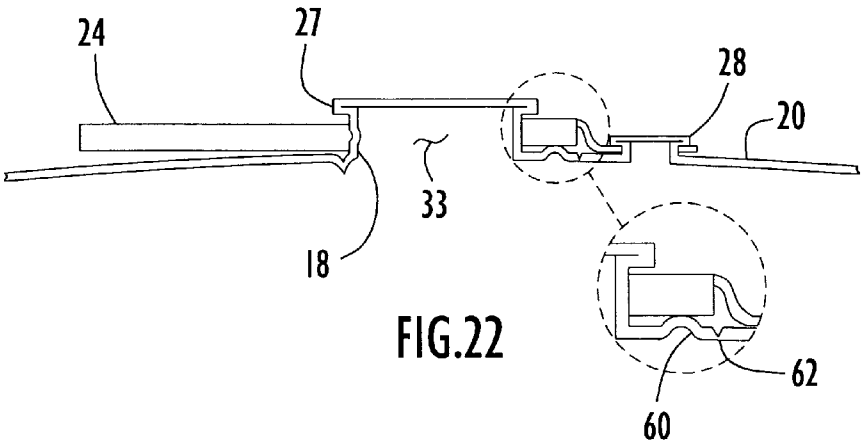
FIG. 22 is a detailed partial side view in cross-section of the top of the beverage can, affixed tab of FIG. 1, and a projection extending from the top of the beverage can and oriented under the tab top.

In yet another embodiment, shown in FIGS. 21 and 22, the amount of force required to tear-away cylinder 18 at seam or score line 30 may be reduced through utilization of one or more projections 60 positioned between tab 24 and the can top. In other respects, the features of the embodiment shown in FIGS. 1–6 are unchanged. The projections 60 extend from either the body of can top 20 toward tab 24 or from the body of tab 24 toward can top 20. The projections 60 may be located outside of the tear-away seam or score line 30 or within an extended tear-away seam or score line 62. The projections 60 serve as fulcrums as one end of tab 24 is lifted causing the force to be applied directly to the tear-away seam or score line 30 at the opposing end of tab 24. Direction of the force applied eases the removal of cylinder 18 at tear-away seam 30, exposing the straw access orifice 33, and lifting straw 10 due to the grasping effect of cylinder dimples 29 as in the previous embodiments.

Figure 19:
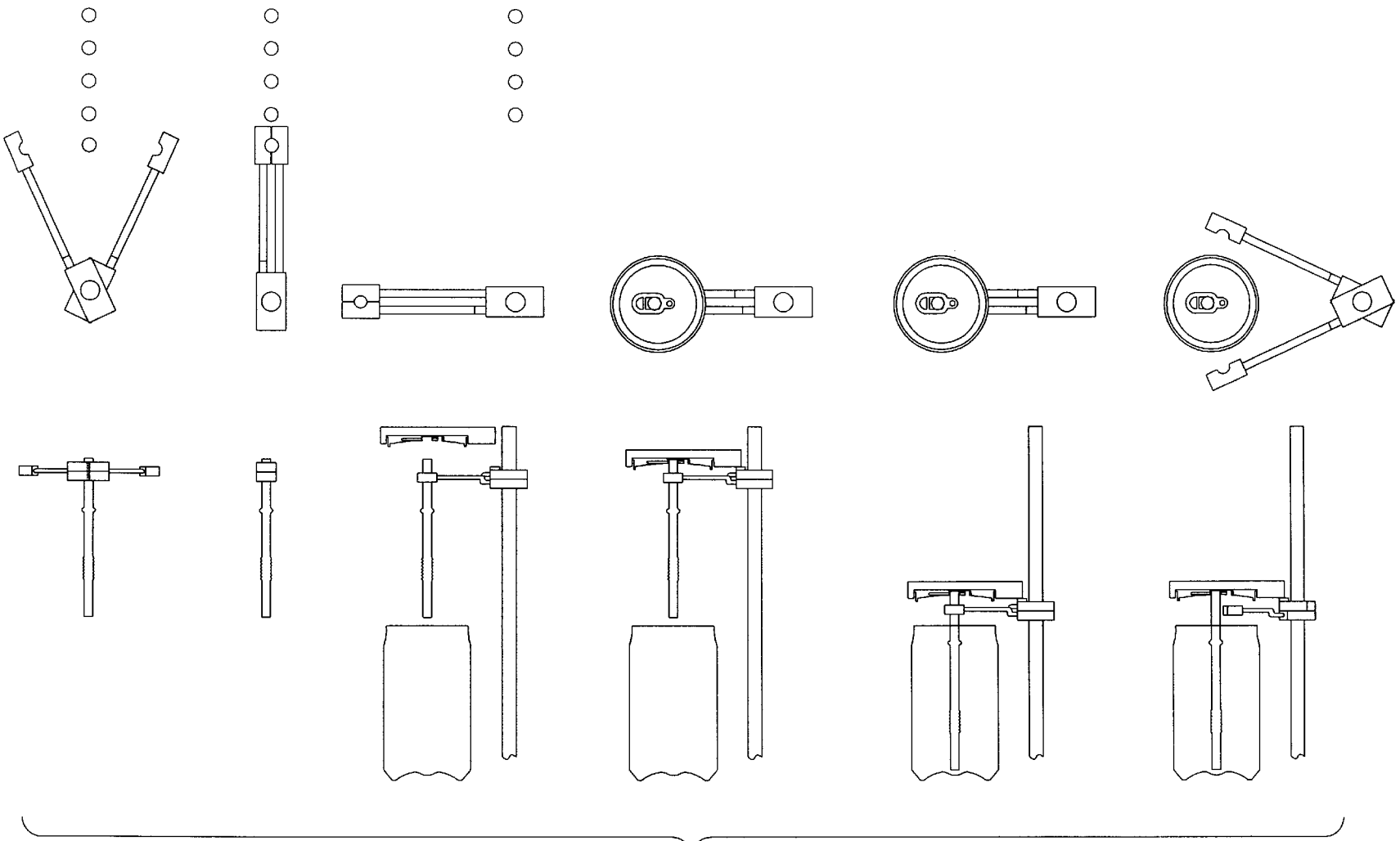
FIG. 19 is a sequence of steps in assembly of a tab top beverage can using a clamp to position and hold the straw.
Figure 20:
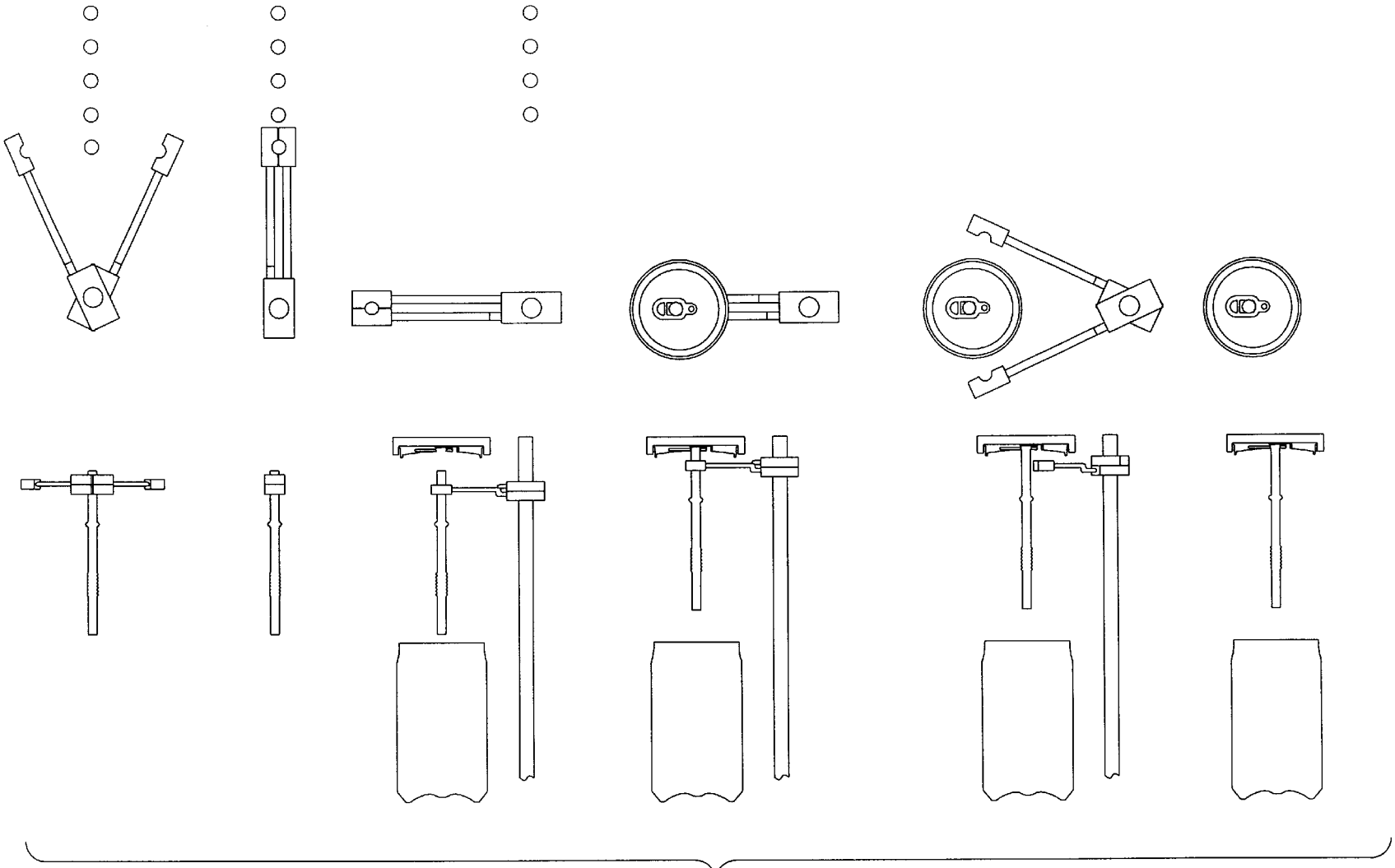
FIG. 20 is a sequence of steps in assembly of a tab top beverage can using dimples in the can top cylinder to position and hold the straw.

Assembly of the beverage can is accomplished, as shown in FIG. 19, by positioning straw 10 over indentation 14 in can bottom 16 and positioning cylinder 18 of can top 20 over the clamped straw, then lowering the can top onto the top of straw, then the top and the straw 10, now grasped by dimples 29 in cylinder 18, is lowered onto the can 12. The top descends until the bellows spring section 38 begins to compress against the resistance of the can bottom at which point the clamp releases the straw and is withdrawn, and the can top descends to the can and is sealed to the can wall. In an alternative mode of assembly, shown in FIG. 20, the straw top is inserted into cylinder or cavity 18 and held therein by the resilient compression of the straw wall by dimples 29 formed in the cavity peripheral wall shown in FIG. 6. The clamp means is removed and the top with the engaged straw is lowered onto the can with the straw bottom positioned in indentation 14 and bellows spring section 38 held in compression as the top is lowered and sealed.

From the foregoing description, it will be appreciated that the invention makes available a novel method and apparatus for providing a practical sanitary self-contained self-presenting straw integrally included with tab top beverage cans as well as a new fabrication technique for tab top beverage cans.

Having described preferred embodiments of the beverage can and straw assembly and methods of fabrication, it is believed that other modifications, variations and changes will be suggested to those skilled in the art in view of the teachings set forth herein. It is therefore to be understood that all such variations, modifications and changes are properly within the scope of the present invention as defined by the appended claims.

What is claimed is:

1. A beverage can with a self-contained self-presenting straw comprising:

a can body having a circumscribing side wall, a bottom connected to said side wall and a top secured to the upper end of said side wall and serving to seal liquid contents within said can;

wherein said top includes an upwardly extending hollow projection having a peripheral wall defining a cavity closed at its upper end, open at its lower end and defining a straw access orifice in said top, said projection having a scored perimeter;

a drinking straw having an upper end and a lower end and an intermediate compressible accordion bellows spring section, said straw having a length greater than the height of said can when said spring section is relaxed, the upper end of said straw extending through the open lower end of the cavity into contact with the closed upper end of the cavity, said lower end of said straw extending into contact with said bottom such that said straw is held between the upper end of said cavity and said bottom by resilient compression of said bellows spring section;

tab means for applying force to and detaching said peripheral wall from said top to permit said resilient accordion pleats to expand and project said straw upper end upwardly through said straw access orifice; and an outwardly extending retention bulge formed in said straw between the upper end and spring section of the straw, said bulge having a cross-section larger than the cross-section of said straw access orifice to prevent passage of said straw entirely out of said can and to facilitate longitudinal expansion of said straw.

2. The beverage can with a self-contained self-presenting straw of claim 1 further comprising:

a pleated extension section formed near the upper end of said straw permitting said straw to be easily extended or bent.

3. The beverage can with a self-contained self-presenting straw of claim 1 further comprising:

a depression formed in said bottom for positioning and stabilizing the straw lower end during fabrication and handling.

4. A beverage can with a self-contained self-presenting straw comprising:

a can body having a circumscribing side wall, a bottom connected to said side wall and a top secured to the upper end of said side wall and serving to seal liquid contents within said can;

wherein said top includes an upwardly extending hollow projection having a peripheral wall defining a cavity closed at its upper end, open at its lower end and defining a straw access orifice in said top, said projection having a scored perimeter;

a drinking straw having an upper end and a lower end and an intermediate compressible accordion bellows spring section, said straw having a length greater than the height of said can when said spring section is relaxed, the upper end of said straw extending through the open lower end of the cavity into contact with the closed upper end of the cavity, said lower end of said straw extending into contact with said bottom such that said straw is held between the upper end of said cavity and said bottom by resilient compression of said bellows spring section; and tab means for applying force to and detaching said peripheral wall from said top to permit said resilient accordion pleats to expand and project said straw upper end upwardly through said straw access orifice;

wherein said cavity peripheral wall has at least one inwardly projecting dimple for grasping said straw upper end.

5. A beverage can with a self-contained self-presenting straw comprising:

a can body having a circumscribing side wall, a bottom connected to said side wall and a top secured to the upper end of said side wall and serving to seal liquid contents within said can;

wherein said top includes an upwardly extending hollow projection having a peripheral wall defining a cavity closed at its upper end, open at its lower end and defining a straw access orifice in said top, said projection having a scored perimeter;

a drinking straw having an upper end and a lower end and an intermediate compressible accordion bellows spring section, said straw having a length greater than the height of said can when said spring section is relaxed, the upper end of said straw extending through the open lower end of the cavity into contact with the closed upper end of the cavity, said lower end of said straw extending into contact with said bottom such that said straw is held between the upper end of said cavity and said bottom by resilient compression of said bellows spring section;

tab means for applying force to and detaching said peripheral wall from said top to permit said resilient accordion pleats to expand and project said straw upper end upwardly through said straw access orifice; and a scored bend-down panel formed in said top, said panel having a scored perimeter defining a pouring access orifice in said top, said panel being bent down to uncover said pouring access orifice by said tab means simultaneously with detachment of said cavity to uncover said straw access orifice.

6. The beverage container with a self-contained self-presenting straw of claim 5 wherein said tab means is positionable to crimpingly seal said upwardly projecting straw while leaving said pouring access orifice uncovered.

7. A beverage can with a self-contained self-presenting straw comprising:

a can body having a circumscribing side wall, a bottom connected to said side wall and a top secured to the upper end of said side wall and serving to seal liquid contents within said can;

wherein said top includes an upwardly extending hollow projection having a peripheral wall defining a cavity closed at its upper end, open at its lower end and defining a straw access orifice in said top, said projection having a scored perimeter;

a drinking straw having an upper end and a lower end and an intermediate compressible accordion bellows spring section, said straw having a length greater than the height of said can when said spring section is relaxed, the upper end of said straw extending through the open lower end of the cavity into contact with the closed upper end of the cavity, said lower end of said straw extending into contact with said bottom such that said straw is held between the upper end of said cavity and said bottom by resilient compression of said bellows spring section;

tab means for applying force to and detaching said peripheral wall from said top to permit said resilient accordion pleats to expand and project said straw upper end upwardly through said straw access orifice; and a scored bend down panel formed in said top, said panel having a scored perimeter defining a pouring access orifice in said top, and means for bending said panel downward independently of said tab means for detaching said cavity.

8. The beverage can with a self-contained self-presenting straw of claim 7 wherein said panel bending means is a second tab co-located in a non-interfering manner with said first tab means.

9. A beverage can with a self-contained self-presenting straw comprising:

a can body having a circumscribing side wall, a bottom connected to said side wall and a top secured to the upper end of said side wall and serving to seal liquid contents within said can;

wherein said top includes an upwardly extending hollow projection having a peripheral wall defining a cavity closed at its upper end, open at its lower end and defining a straw access orifice in said top, said projection having a scored perimeter;

a drinking straw having an upper end and a lower end and an intermediate compressible accordion bellows spring section, said straw having a length greater than the height of said can when said spring section is relaxed, the upper end of said straw extending through the open lower end of the cavity into contact with the closed upper end of the cavity, said lower end of said straw extending into contact with said bottom such that said straw is held between the upper end of said cavity and said bottom by resilient compression of said bellows spring section; and tab means for applying force to and detaching said peripheral wall from said top to permit said resilient accordion pleats to expand and project said straw upper end upwardly through said straw access orifice;

"an outwardly extending retention bulge formed in said straw between the upper end and spring section of the straw, said bulge having a cross-section larger than the cross-section of said straw access orifice to prevent passage of said straw entirely out of said can and to facilitate longitudinal expansion of the straw;

wherein a projection is fixed in said tab means serving as a fulcrum to provide a mechanical advantage when the tab means applies force to said peripheral wall.

* * * * *